US010546558B2

(12) United States Patent
Schaub et al.

(10) Patent No.: US 10,546,558 B2
(45) Date of Patent: Jan. 28, 2020

(54) REQUEST AGGREGATION WITH OPPORTUNISM

(71) Applicant: Apple Inc., Cupertino, CA (US)

(72) Inventors: Marc A. Schaub, Sunnyvale, CA (US); Jeffrey J. Irwin, Cupertino, CA (US); Peter F. Holland, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 1372 days.

(21) Appl. No.: 14/262,298

(22) Filed: Apr. 25, 2014

(65) Prior Publication Data

US 2015/0310900 A1 Oct. 29, 2015

(51) Int. Cl.
*G09G 5/36* (2006.01)

(52) U.S. Cl.
CPC ..... *G09G 5/363* (2013.01)

(58) Field of Classification Search
CPC ..... G09G 5/363; G09G 2370/20; G09G 2360/128; G09G 2330/021; G06T 1/20
See application file for complete search history.

(56) References Cited

U.S. PATENT DOCUMENTS 8,922,571 B2 12/2014 Tripathi et al.
9,117,299 B2 8/2015 Kuo et al.
2003/0137528 A1* 7/2003 Wasserman ..... G06F 3/1431 715/700

* cited by examiner

*Primary Examiner* — Michael Alsip
(74) *Attorney, Agent, or Firm* — Meyertons Hood Kivlin Kowert and Goetzel PC; Rory D. Rankin

(57) ABSTRACT

Systems, apparatuses, and methods for aggregating memory requests with opportunism in a display pipeline. Memory requests are aggregated for each requestor of a plurality of requestors in the display pipeline. When the number of memory requests for a given requestor reaches a corresponding threshold, memory requests may be issued for the given requestor. In response to determining the given requestor has reached its threshold, other requestors may issue memory requests even if they have not yet aggregated enough memory requests to reach their corresponding thresholds.

20 Claims, 9 Drawing Sheets

REQUEST AGGREGATION WITH OPPORTUNISM

BACKGROUND

Technical Field

Embodiments described herein relate to semiconductor chips, and more particularly, to efficiently scheduling memory access requests.

Description of the Related Art

A semiconductor chip may include multiple functional blocks or units, each capable of accessing a shared memory. In some embodiments, the multiple functional units are individual dies on an integrated circuit (IC), such as a system-on-a-chip (SOC). In other embodiments, the multiple functional units are individual dies within a package, such as a multi-chip module (MCM). In yet other embodiments, the multiple functional units are individual dies or chips on a printed circuit board. A memory controller may control access to the shared memory.

The multiple functional units on the chip are sources for memory access requests sent to the memory controller. Additionally, one or more functional units may include multiple sources for memory access requests to send to the memory controller. For example, a video subsystem in a computing system may include multiple sources for video data. The design of a smartphone or computer tablet may include user interface layers, cameras, and video sources such as media players. Each of these sources may utilize video data stored in memory. A corresponding display controller may include multiple internal pixel-processing pipelines for these sources.

Each request sent from one of the multiple sources includes both overhead processing and information retrieval processing. A large number of requests from separate sources of the multiple sources on the chip may create a bottleneck in the memory subsystem. The repeated overhead processing may reduce the subsystem performance.

In some embodiments, the refresh rate of a display screen may be 60 frames-per-second, where the display screen is continually updated. However, in some cases, such as when a user is web browsing and has stopped at a single webpage for a considerable amount of time, this may cause long pauses to updates on the display screen. In addition, many areas of the chip may be inactive while the display screen is idle. However, the memory subsystem may not be able to enter a low-power mode as one or more display pipelines continue to access the shared memory. The shared memory may be off-die synchronous dynamic random access memory (SDRAM) used to store frame data in frame buffers. The accesses of the SDRAM consume an appreciable amount of power in addition to preventing the memory subsystem from entering a low-power mode.

In view of the above, methods and mechanisms for efficiently scheduling memory access requests are desired.

SUMMARY

Systems and methods for performing request aggregation with opportunism are disclosed.

Systems and methods for efficiently scheduling memory access requests are contemplated. In various embodiments, a semiconductor chip includes a memory controller and a display controller. The memory controller may control accesses to a shared memory, such as an external memory located off of the semiconductor chip. The display controller may include one or more internal pixel-processing pipelines.

Each of the pixel-processing pipelines may be able to process the frame data received from the memory controller for a respective video source.

A frame may be processed by the display controller and presented on a respective display screen. During processing, control logic within the display controller may send multiple memory access requests to the memory controller. In response to detecting an idle display for each supported and connected display, the display controller aggregates a number of memory requests for a given display pipeline of the one or more display pipelines prior to attempting to send any memory requests from the given display pipeline to the memory controller. The number of memory requests to aggregate may be a programmable value. The display controller may receive an indication, or otherwise determine, that functional blocks on the semiconductor chip do not access the shared memory. In some embodiments, the indication may act as a further qualification to begin aggregating memory requests. In response to not receiving memory access requests from the functional blocks or the display controller, the memory controller may transition to a low-power mode.

The display controller may include a plurality of requestors, wherein each requestor is configured to generate and issue memory requests independently of the other requestors. Each requestor may be configured to wait to issue memory requests until a threshold number of memory requests has been aggregated. In one embodiment, each requestor may have a separate programmable threshold. When a first requestor aggregates a number of memory requests equal to or exceeding its programmable threshold, the first requestor may begin issuing memory requests to memory. Additionally, other requestors may opportunistically issue memory requests (or otherwise be permitted to transmit requests) once the first requestor begins issuing memory requests even if the other requestors have not yet reached their respective thresholds. In this way, bursts of memory traffic may be generated during short periods of time, allowing the memory subsystem to maximize the amount of time spent in power savings mode.

These and other features and advantages will become apparent to those of ordinary skill in the art in view of the following detailed descriptions of the approaches presented herein.

BRIEF DESCRIPTION OF THE DRAWINGS

The above and further advantages of the methods and mechanisms may be better understood by referring to the following description in conjunction with the accompanying drawings, in which.

DETAILED DESCRIPTION OF EMBODIMENTS

Figure 1:
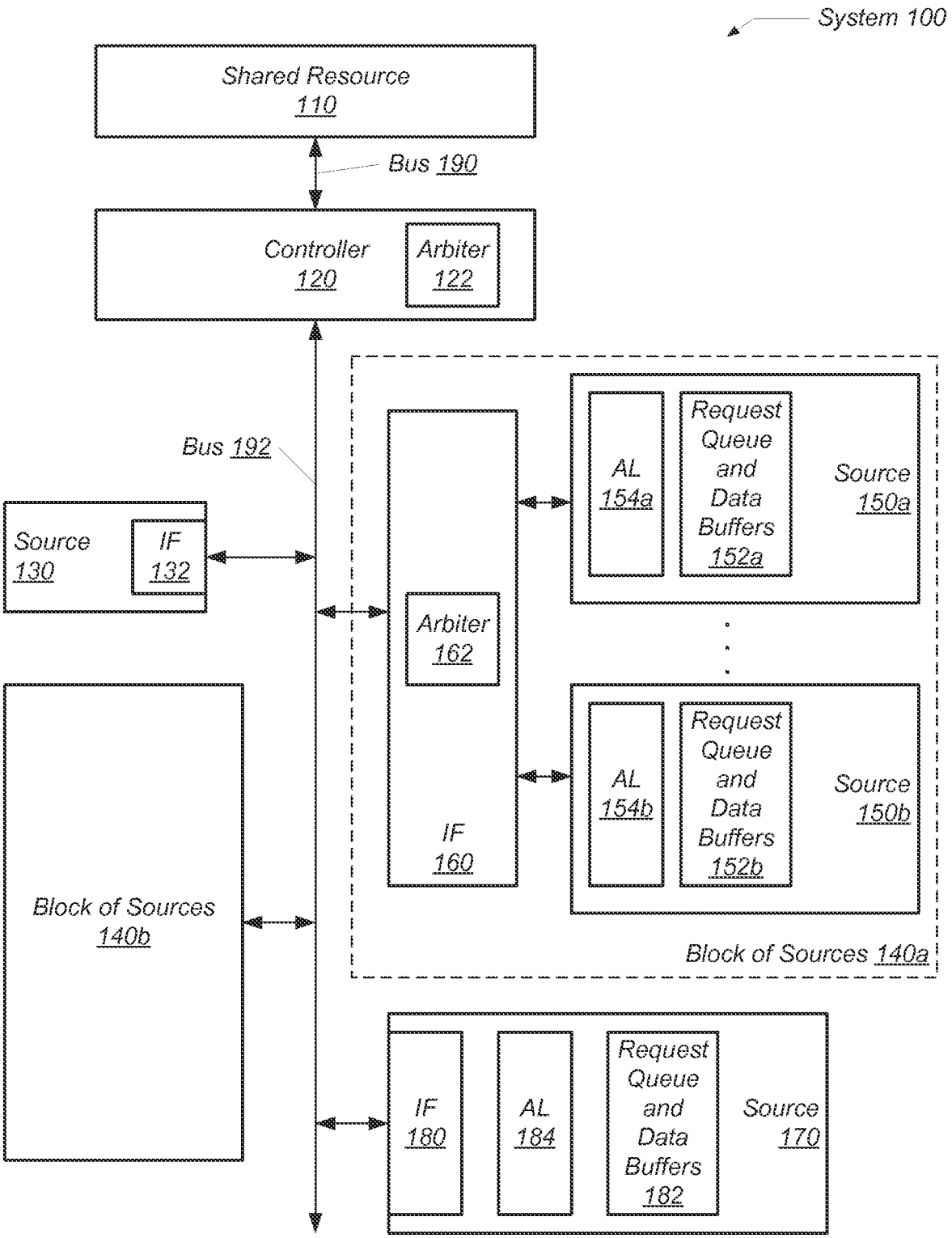
FIG. 1 is a block diagram illustrating one embodiment of a system with control of shared resource access traffic.

In the following description, numerous specific details are set forth to provide a thorough understanding of the methods and mechanisms presented herein. However, one having ordinary skill in the art should recognize that the various embodiments may be practiced without these specific details. In some instances, well-known structures, components, signals, computer program instructions, and techniques have not been shown in detail to avoid obscuring the approaches described herein. It will be appreciated that for simplicity and clarity of illustration, elements shown in the figures have not necessarily been drawn to scale. For example, the dimensions of some of the elements may be exaggerated relative to other elements.

This specification includes references to "one embodiment". The appearance of the phrase "in one embodiment" in different contexts does not necessarily refer to the same embodiment. Particular features, structures, or characteristics may be combined in any suitable manner consistent with this disclosure. Furthermore, as used throughout this application, the word "may" is used in a permissive sense (i.e., meaning having the potential to), rather than the mandatory sense (i.e., meaning must). Similarly, the words "include", "including", and "includes" mean including, but not limited to.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "An apparatus comprising a display pipeline . . . " Such a claim does not foreclose the apparatus from including additional components (e.g., a processor, a memory controller).

"Configured To." Various units, circuits, or other components may be described or claimed as "configured to" perform a task or tasks. In such contexts, "configured to" is used to connote structure by indicating that the units/circuits/components include structure (e.g., circuitry) that performs the task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. § 112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in a manner that is capable of performing the task(s) at issue. "Configured to" may also include adapting a manufacturing process (e.g., a semiconductor fabrication facility) to fabricate devices (e.g., integrated circuits) that are adapted to implement or perform one or more tasks.

"First," "Second," etc. As used herein, these terms are used as labels for nouns that they precede, and do not imply any type of ordering (e.g., spatial, temporal, logical, etc.). For example, in a display controller with a plurality of requestors, the terms "first" and "second" requestors can be used to refer to any two of the plurality of requestors.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

Referring now to FIG. 1, a generalized block diagram of one embodiment of a system 100 with control of shared resource access traffic is shown. As shown, a controller 120 provides controlled access to a shared resource 110. In some embodiments, the resource 110 is a shared memory and the controller 120 is a memory controller. In other examples, the shared resource 110 may be a complex arithmetic unit or a network switching fabric. Other examples of a resource and its associated controller are possible and contemplated. The controller 120 may receive requests that access the resource 110 from multiple sources, such as sources 130 and 170 and the block of sources 140*a*-140*b*. The sources may also be referred to as requestors.

The system 100 may include a hybrid arbitration scheme wherein the controller 120 includes a centralized arbiter 122 and one or more of the sources include distributed arbitration logic. For example, each one of the blocks of sources 140*a*-140*b* may include an arbiter. The block of sources 140*a* includes arbiter 162 for selecting a given request to place on the bus 192 from multiple requests generated by the sources 150*a*-150*b*. The arbiter 122 within the controller 120 may select a given request to place on the bus 190 from multiple requests received from the sources 130 and 170 and the block of sources 140*a*-140*b*. The arbitration logic used by at least the arbiters 122 and 162 may include any type of request traffic control scheme. For example, a round robin, a least-recently-used, an encoded priority, and other schemes may be used.

Each of the sources 130 and 170 and the block of sources 140*a*-140*b* may include interface logic to connect to the bus 192. For example, the source 130 includes interface (IF) 132, the source 170 includes IF 180, and the block of sources 140*a* includes IF 160. A given protocol may be used by the interface logic dependent on the bus 192. In some examples, the bus 192 may also be a switch fabric. Each of the sources in the system 100 may store generated requests for the shared resource 110. A request queue may be used for the storage. The sources 150*a*-150*b* include request queues and response data buffers 152*a*-152*b* for storing generated requests for the shared resource 110 and storing corresponding response data. Although not shown, other sources within the system 100 may include request queues and response data buffers. Alternatively, a respective request queue and a respective response data buffer may be located within an associated interface.

One or more of the sources in the system 100 may include request aggregate logic. An associated source generates requests for the shared resource 110 and stores the requests in a request queue. However, in various embodiments, the associated response data buffer may first deallocate a sufficient number of entries to store the response data before the read requests are generated and stored in the request queue. The source may not be a candidate for arbitration, and additionally, read requests may not be generated until sufficient storage space is available in the response data buffer. The sufficient amount of storage space may be measured as a number of generated read requests. For example, each read request may retrieve a given amount of data, such as 64 bytes. Therefore, the amount of available space to free in the response data buffer may be divided by the 64-byte size to convert to a number of read requests. A count may be performed as space is made available in the response data buffer. The source may not be a candidate for arbitration until the counted number of read requests to generate reaches a given threshold. The given threshold may be a programmable number stored in a configuration register.

The block of sources 140*a* includes aggregate logic (AL) 154*a* for source 150*a* and AL 154*b* for source 150*b*. The source 170 includes AL 184. Until the given threshold is reached, no read requests may be generated and stored in a corresponding read queue. The arbiter 162 may not use a given one of the sources 150*a*-150*b* as a candidate for selecting requests to send to the controller 120. Similarly, until a given threshold is reached, the source 170 may not send any requests or an indication as a candidate for arbitration to the controller 120.

In some embodiments, the aggregate logic is not used or enabled until an aggregate condition is satisfied. For example, the system 100 may be operating in a mode wherein only a single source or a single block of sources is still generating requests for the shared resource 110. For example, the block of sources 140*a* may be a display controller. The system 100 may be in an idle state, wherein a user of the system 100 is not executing any applications. The user may be away from a corresponding device using the system 100. Alternatively, the user may be reading browsing search results. No functional block may be accessing a shared memory in this idle state except for the display controller. Any active display connected to the system 100 may be idle.

The memory accesses by the display controller may prevent the shared memory from transitioning to a low-power mode. However, in response to determining the idle state, the display controller may aggregate a relatively large amount of storage space for response data prior to generating memory read requests before becoming a candidate for arbitration. A relatively large number of memory read requests may be generated afterward, which eventually causes the display controller to become a candidate for arbitration and a source of memory read requests when selected. As a result, the shared memory may not be accessed for a relatively large amount of time as no other functional blocks are accessing the shared memory during the idle time. Therefore, the shared memory may spend longer amounts of time in a low-power mode causing an overall reduction in power consumption.

Similar to the block of sources 140*a*, which includes multiple sources 150*a*-150*b*, the display controller may include multiple sources or requestors for memory accesses. For example, the display controller may include multiple display pipelines, each associated with a separate display screen. In addition, each display pipeline may include multiple requestors, such as separate layers or sources for video data. Examples may include user interface (UI) layers and video layers, such as multimedia players.

A source among the sources 140*a*-140*b* and the source 170 may send queued memory read requests uninterrupted to the shared resource 110 through the controller 120, in response to: the source is in an aggregate mode, the selected source reaches the given threshold of a number of queued requests, and the source is selected by arbitration logic. In various embodiments, no arbitration may occur while the selected source sends its queued requests. In some embodiments, the selected source may send a request that is generated after winning arbitration and before sending a last request stored in the request queue.

Figure 2:
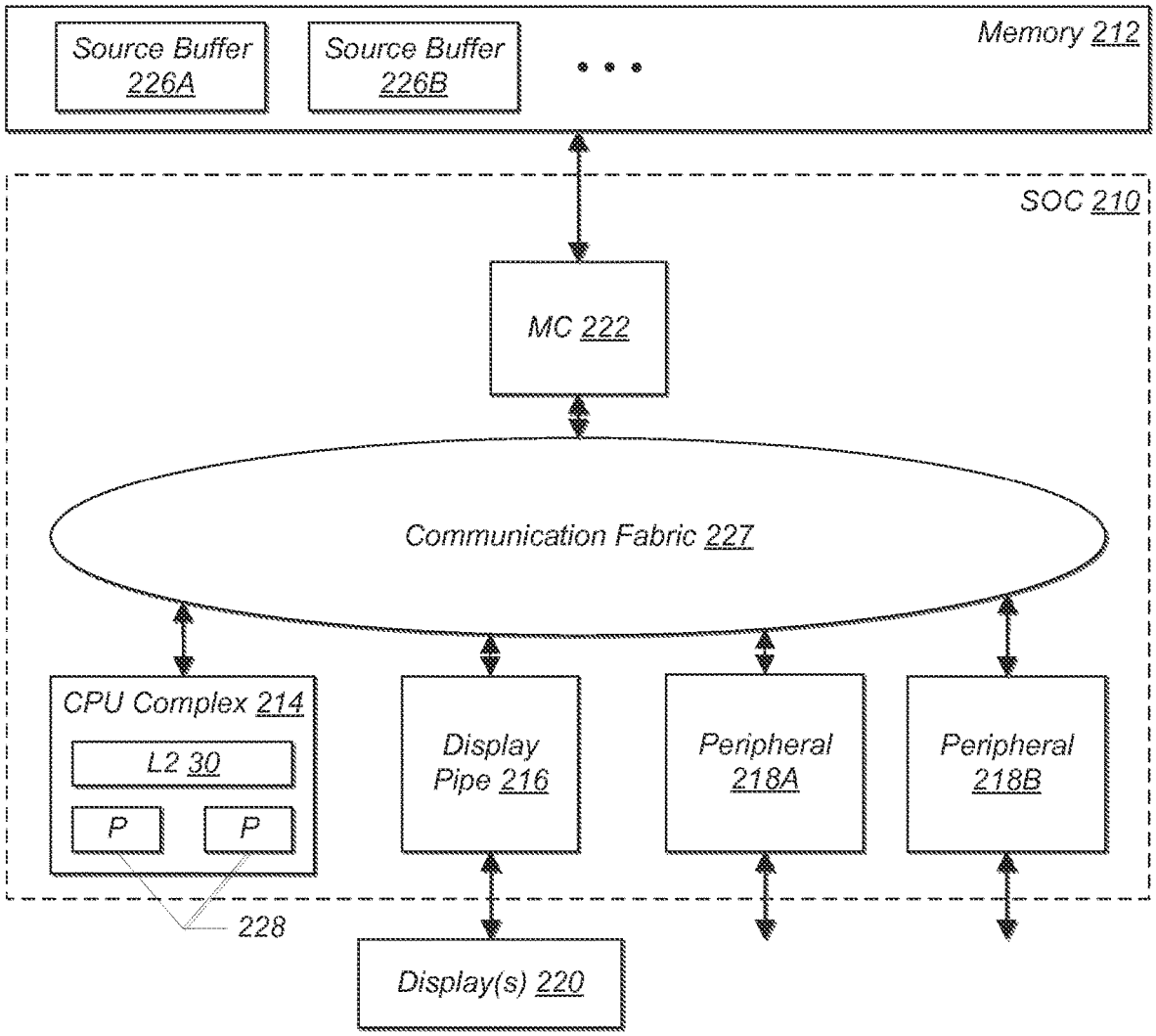
FIG. 2 is a block diagram illustrating one embodiment of a system on chip (SOC) coupled to a memory and one or more display devices.

Turning now to FIG. 2, a block diagram of one embodiment of a system on chip (SOC) 210 is shown coupled to a memory 212 and one or more display devices 220. A display device may be more briefly referred to herein as a display. As implied by the name, the components of the SOC 210 may be integrated onto a single semiconductor substrate as an integrated circuit "chip." In some embodiments, the components may be implemented on two or more discrete chips in a system. However, the SOC 210 will be used as an example herein. In the illustrated embodiment, the components of the SOC 210 include a central processing unit (CPU) complex 214, a display pipe 216, peripheral components 218A-218B (more briefly, "peripherals"), a memory controller 222, and a communication fabric 227. The components 214, 216, 218A-218B, and 222 may all be coupled to the communication fabric 227. The memory controller 222 may be coupled to the memory 212 during use. Similarly, the display pipe 216 may be coupled to the displays 220 during use. In the illustrated embodiment, the CPU complex 214 includes one or more processors 228 and a level two (L2) cache 30.

The display pipe 216 may include hardware to process one or more still images and/or one or more video sequences for display on the displays 220. Generally, for each source still image or video sequence, the display pipe 216 may be configured to generate read memory operations to read the data representing the frame/video sequence from the memory 212 through the memory controller 222. In one embodiment, each read operation may include a quality of service (QoS) parameter that specifies the requested QoS level for the operation. The QoS level may be managed to ensure that the display pipe 216 is provided with data in time to continue displaying images without visual artifacts (e.g., incorrect pixels being displayed, "skipping", or other visually-identifiable incorrect operation).

The display pipe 216 may be configured to perform any type of processing on the image data (still images, video sequences, etc.). In one embodiment, the display pipe 216 may be configured to scale still images and to dither, scale, and/or perform color space conversion on the frames of a video sequence. The display pipe 216 may be configured to blend the still image frames and the video sequence frames to produce output frames for display. The display pipe 216 may also be more generally referred to as a display control unit or a display controller. A display control unit may generally be any hardware configured to prepare a frame for display from one or more sources, such as still images and/or video sequences.

More particularly, the display pipe 216 may be configured to retrieve source frames from one or more source buffers 226A-226B stored in the memory 212, composite frames from the source buffers, and display the resulting frames on the display 220. Source buffers 226A and 226B are representative of any number of source buffers which may be stored in memory 212. Accordingly, display pipe 216 may be configured to read the multiple source buffers 226A-226B and composite the image data to generate the output frame. In some embodiments, rather than displaying the output frame, the resulting frame may be written back to memory 212. In one embodiment, there may be four separate requestors in display pipe 216, and each requestor may retrieve data from a separate plane of a video or user interface frame. In other embodiments, display pipe 216 may include other numbers of requestors.

The displays 220 may be any sort of visual display devices. The displays may include, for example, touch screen style displays for mobile devices such as smart phones, tablets, etc. Various displays 220 may include liquid crystal display (LCD), light emitting diode (LED), plasma, cathode ray tube (CRT), etc. The displays may be integrated into a system including the SOC 210 (e.g. a smart phone or tablet) and/or may be a separately housed device such as a computer monitor, television, or other device. The displays may also include displays coupled to the SOC 210 over a network (wired or wireless).

In some embodiments, the displays 220 may be directly connected to the SOC 210 and may be controlled by the display pipe 216. That is, the display pipe 216 may include hardware (a "backend") that may provide various control/data signals to the display, including timing signals such as one or more clocks and/or the vertical blanking interval and horizontal blanking interval controls. The clocks may include the pixel clock indicating that a pixel is being transmitted. The data signals may include color signals such as red, green, and blue, for example. The display pipe 216 may control the displays 220 in real-time, providing the data indicating the pixels to be displayed as the display is displaying the image indicated by the frame. The interface to such displays 220 may be, for example, VGA, HDMI, digital video interface (DVI), a liquid crystal display (LCD) interface, a plasma interface, a cathode ray tube (CRT) interface, any proprietary display interface, etc.

Various situations may occur when the display contents of displays 220 are static for a period of time. In one example, a user reading search results during browsing may cause long pauses to updates on a given display screen. Many, if not all, of the devices on the SOC 210 outside of the display pipe 216 may be inactive while one or more display screens are idle. Although many of the devices on the SOC 210 may be able to transition to a low-power mode, the fabric 227, memory controller 222, and memory 212 may not be able to transition to a low-power mode. The refresh rate of a display screen may be 60 frames-per-second. The display pipe 216 may be sending memory access requests to the memory 212 for video frame data during the idle pauses in user activity. The accesses of the off-die SDRAM consume an appreciable amount of power in addition to preventing fabric 227, memory controller 222, and memory 212 from entering a low-power mode.

The display pipe 216 may include an arbiter for selecting a given request to send to the memory controller 222 through the fabric 227. Memory access requests may be stored in a request queue. The display pipe 216 may include request aggregate logic. The aggregate logic may prevent a given requestor from being a candidate for arbitration. In some embodiments, a requestor may not be a candidate for arbitration until the number of stored requests reaches a given threshold. The threshold may be measured as a corresponding number of memory read requests. The given threshold may be a programmable number stored in a configuration register. Until the given threshold is reached, a corresponding arbiter may not use the requestor as a candidate for selecting requests to send to the fabric 227. In some embodiments, the aggregate logic is not used until an aggregate condition is satisfied. For example, the idle pause in user activity may be one condition.

In response to determining the idle state, the display pipe 216 may aggregate a relatively large number of memory access requests or a large amount of corresponding response data, depending on the implementation, before becoming a candidate for arbitration. As a result, the fabric 227, memory controller 222, and memory 212 may not be accessed for a relatively large amount of time as no other functional blocks, or IC devices, on the SOC 210 are accessing the shared memory 212 during the idle time. Therefore, fabric 227, memory controller 222, and/or memory 212 may spend longer amounts of time in a low-power mode causing an overall reduction in power consumption.

The CPU complex 214 may include one or more CPU processors 228 that serve as the CPU of the SOC 210. The CPU of the system includes the processor(s) that execute the main control software of the system, such as an operating system. Generally, software executed by the CPU during use may control the other components of the system to realize the desired functionality of the system. The CPU processors 228 may also execute other software, such as application programs. The application programs may provide user functionality, and may rely on the operating system for lower level device control. Accordingly, the CPU processors 228 may also be referred to as application processors. The CPU complex may further include other hardware such as the L2 cache 30 and/or an interface to the other components of the system (e.g., an interface to the communication fabric 227).

The peripherals 218A-218B may be any set of additional hardware functionality included in the SOC 210. For example, the peripherals 218A-218B may include video peripherals such as video encoder/decoders, image signal processors for image sensor data such as camera, scalers, rotators, blenders, graphics processing units, etc. The peripherals 218A-218B may include audio peripherals such as microphones, speakers, interfaces to microphones and speakers, audio processors, digital signal processors, mixers, etc. The peripherals 218A-218B may include interface controllers for various interfaces external to the SOC 210 including interfaces such as Universal Serial Bus (USB), peripheral component interconnect (PCI) including PCI Express (PCIe), serial and parallel ports, etc. The peripherals 218A-218B may include networking peripherals such as media access controllers (MACs). Any set of hardware may be included.

The memory controller 222 may generally include the circuitry for receiving memory operations from the other components of the SOC 210 and for accessing the memory 212 to complete the memory operations. The memory controller 222 may be configured to access any type of memory 212. For example, the memory 212 may be static random access memory (SRAM), dynamic RAM (DRAM) such as synchronous DRAM (SDRAM) including double data rate (DDR, DDR2, DDR3, etc.) DRAM. Low power/mobile versions of the DDR DRAM may be supported (e.g. LPDDR, mDDR, etc.). The memory controller 222 may include various queues for buffering memory operations, data for the operations, etc., and the circuitry to sequence the operations and access the memory 212 according to the interface defined for the memory 212.

The communication fabric 227 may be any communication interconnect and protocol for communicating among the components of the SOC 210. The communication fabric 227 may be bus-based, including shared bus configurations, cross bar configurations, and hierarchical buses with bridges. The communication fabric 227 may also be packet-based, and may be hierarchical with bridges, cross bar, point-to-point, or other interconnects.

It is noted that the number of components of the SOC 210 (and the number of subcomponents for those shown in FIG.

2, such as within the CPU complex 214) may vary from embodiment to embodiment. There may be more or fewer of each component/subcomponent than the number shown in FIG. 2. It is also noted that SOC 210 may include many other components not shown in FIG. 2. In various embodiments, SOC 210 may also be referred to as an integrated circuit (IC), an application specific integrated circuit (ASIC), or an apparatus.

Figure 3:
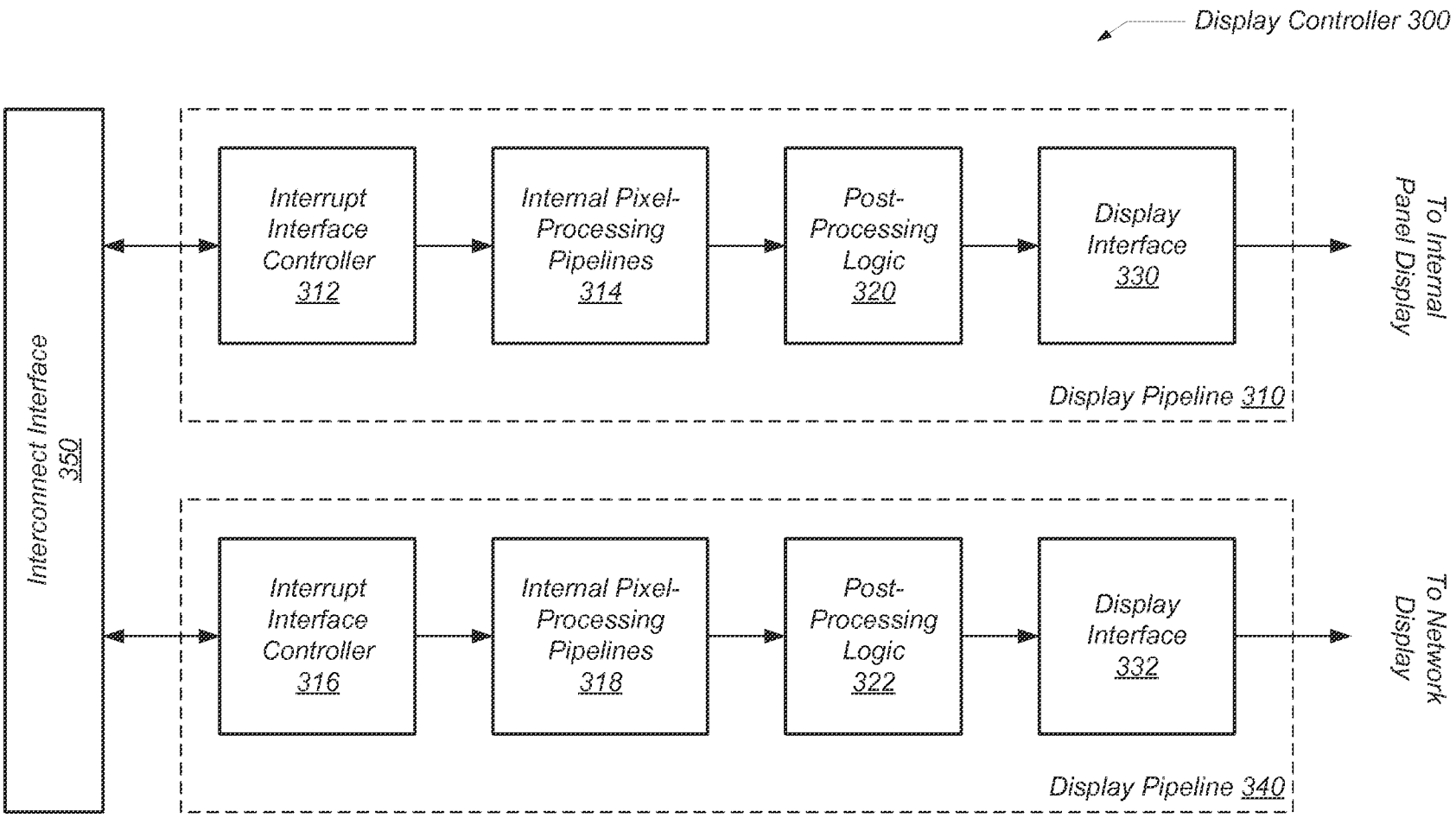
FIG. 3 is a block diagram illustrating one embodiment of a display controller.

Turning now to FIG. 3, a generalized block diagram of one embodiment of a display controller 300 is shown. The display controller 300 includes an interconnect interface 350 and two display pipelines 310 and 340. Although two display pipelines are shown, the display controller 300 may include another number of display pipelines. Each of the display pipelines may be associated with a separate display screen. For example, the display pipeline 310 may send rendered graphical information to an internal display panel. The display pipeline 340 may send rendered graphical information to a network-connected display. Other examples of display screens may also be possible and contemplated.

The interconnect interface 350 may include multiplexers and control logic for routing signals and packets between the display pipelines 310 and 340 and a top-level fabric. Display pipeline 310 may include interrupt interface controller 312 and display pipeline 340 may include interrupt interface controller 316. The interrupt interface controllers 312 and 316 may include logic to expand a number of sources or external devices to generate interrupts to be presented to the internal pixel-processing pipelines 314. The controllers 312 and 316 may provide encoding schemes, registers for storing interrupt vector addresses, and control logic for checking, enabling, and acknowledging interrupts. The number of interrupts and a selected protocol may be configurable.

Display pipelines 310 and 340 within display controller 300 may include one or more internal pixel-processing pipelines 314 and 318, respectively. The internal pixel-processing pipelines 314 and 318 may include one or more ARGB (Alpha, Red, Green, Blue) pipelines for processing and displaying user interface (UI) layers. The internal pixel-processing pipelines 314 and 318 may include one or more pipelines for processing and displaying video content such as YUV content. In some embodiments, each of the internal pixel-processing pipelines 314 and 318 include blending circuitry for blending graphical information before sending the information as output to respective displays.

A layer may refer to a presentation layer. A presentation layer may consist of multiple software components used to define one or more images to present to a user. The UI layer may include components for at least managing visual layouts and styles and organizing browses, searches, and displayed data. The presentation layer may interact with process components for orchestrating user interactions and also with the business or application layer and the data access layer to form an overall solution. However, the internal pixel-processing pipelines 314 and 318 handle the UI layer portion of the solution.

The YUV content is a type of video signal that consists of three separate signals. One signal is for luminance or brightness. Two other signals are for chrominance or colors. The YUV content may replace the traditional composite video signal. The MPEG-2 encoding system in the DVD format uses YUV content. The internal pixel-processing pipelines 314 and 318 handle the rendering of the YUV content. A further description of the internal pixel-processing pipelines is provided shortly.

In various embodiments, each of the pipelines within the internal pixel-processing pipelines 314 and 318 may have request aggregate logic. In other embodiments, the granularity of the request aggregate logic may be less fine and set for each one of the display pipelines 310 and 340.

The display pipeline 310 may include post-processing logic 320. The post-processing logic 320 may be used for color management, ambient-adaptive pixel (AAP) modification, dynamic backlight control (DPB), panel gamma correction, and dither. The display interface 330 may handle the protocol for communicating with the internal panel display. For example, the Mobile Industry Processor Interface (MIPI) Display Serial Interface (DSI) specification may be used. Alternatively, a 4-lane Embedded Display Port (eDP) specification may be used.

The display pipeline 340 may include post-processing logic 322. The post-processing logic 322 may be used for supporting scaling using a 5-tap vertical, 9-tap horizontal, 16-phase filter. The post-processing logic 322 may also support chroma subsampling, dithering, and write back into memory using the ARGB888 (Alpha, Red, Green, Blue) format or the YUV420 format. The display interface 332 may handle the protocol for communicating with the network-connected display. A direct memory access (DMA) interface may be used.

Figure 4:
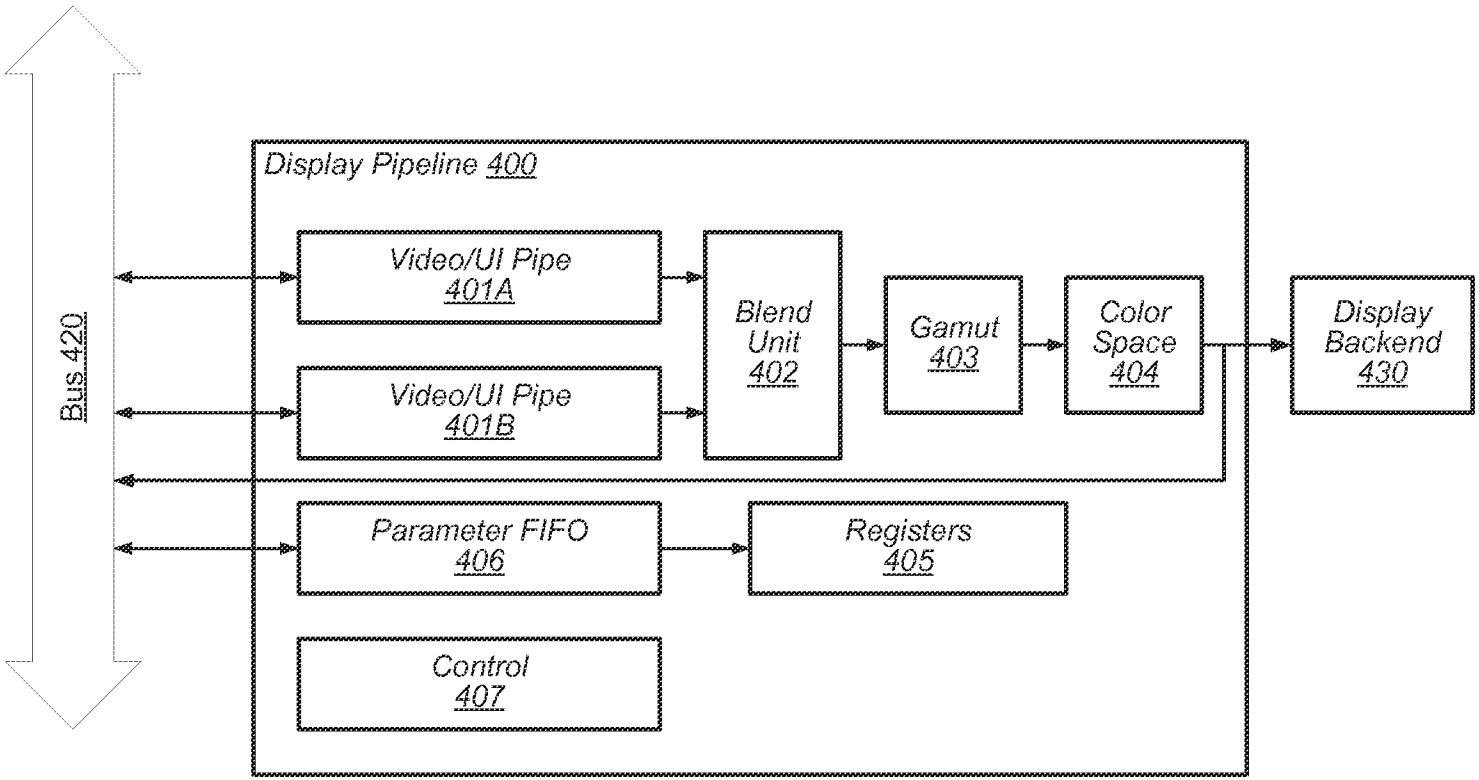
FIG. 4 is a block diagram illustrating one embodiment of a display pipeline.

FIG. 4 illustrates one embodiment of a display pipeline 400. Display pipeline 400 may represent display pipe 216 included in SOC 210 in FIG. 2. Display pipeline 400 may be coupled to a system bus 420 and to a display backend 430. In some embodiments, display backend 430 may directly interface to the display to display pixels generated by display pipeline 400. Display pipeline 400 may include functional sub-blocks such as one or more video/user interface (UI) pipelines 401A-B, blend unit 402, gamut adjustment block 403, color space converter 404, registers 405, parameter First-In First-Out buffer (FIFO) 406, and control unit 407. Display pipeline 400 may also include other components which are not shown in FIG. 4 to avoid cluttering the figure.

System bus 420, in some embodiments, may correspond to communication fabric 227 from FIG. 2. System bus 420 couples various functional blocks such that the functional blocks may pass data between one another. Display pipeline 400 may be coupled to system bus 420 in order to receive video frame data for processing. In some embodiments, display pipeline 400 may also send processed video frames to other functional blocks and/or memory that may also be coupled to system bus 420.

The display pipeline 400 may include one or more video/UI pipelines 401A-B, each of which may be a video and/or user interface (UI) pipeline depending on the embodiment. It is noted that the terms "video/UI pipeline" and "pixel processing pipeline" may be used interchangeably herein. In other embodiments, display pipeline 400 may have one or more dedicated video pipelines and/or one or more dedicated UI pipelines. Each video/UI pipeline 401 may fetch a video or image frame from a buffer coupled to system bus 420. The buffered video or image frame may reside in a system memory such as, for example, system memory 212 from FIG. 2. Each video/UI pipeline 401 may fetch a distinct image and may process the image in various ways, including, but not limited to, format conversion (e.g., YCbCr to ARGB), image scaling, and dithering. In some embodiments, each video/UI pipeline may process one pixel at a time, in a specific order from the video frame, outputting a stream of pixel data, and maintaining the same order as pixel data passes through.

In one embodiment, when utilized as a user interface pipeline, a given video/UI pipeline 401 may support programmable active regions in the source image. The active regions may define the only portions of the source image to be displayed. In an embodiment, the given video/UI pipeline 401 may be configured to only fetch data within the active regions. Outside of the active regions, dummy data with an alpha value of zero may be passed as the pixel data.

Control unit 407 may, in various embodiments, be configured to arbitrate read requests to fetch data from memory from video/UI pipelines 401A-B. In some embodiments, the read requests may point to a virtual address. A memory management unit (not shown) may convert the virtual address to a physical address in memory prior to the requests being presented to the memory. In some embodiments, control unit 407 may include a dedicated state machine or sequential logic circuit. A general purpose processor executing program instructions stored in memory may, in other embodiments, be employed to perform the functions of control unit 407.

Blending unit 402 may receive a pixel stream from one or more of video/UI pipelines 401A-B. If only one pixel stream is received, blending unit 402 may simply pass the stream through to the next sub-block. However, if more than one pixel stream is received, blending unit 402 may blend the pixel colors together to create an image to be displayed. In various embodiments, blending unit 402 may be used to transition from one image to another or to display a notification window on top of an active application window. For example, a top layer video frame for a notification, such as, for a calendar reminder, may need to appear on top of, i.e., as a primary element in the display, despite a different application, an internet browser window for example. The calendar reminder may comprise some transparent or semi-transparent elements in which the browser window may be at least partially visible, which may require blending unit 402 to adjust the appearance of the browser window based on the color and transparency of the calendar reminder. The output of blending unit 402 may be a single pixel stream composite of the one or more input pixel streams.

The output of blending unit 402 may be sent to gamut adjustment unit 403. Gamut adjustment 403 may adjust the color mapping of the output of blending unit 402 to better match the available color of the intended target display. The output of gamut adjustment unit 403 may be sent to color space converter 404. Color space converter 404 may take the pixel stream output from gamut adjustment unit 403 and convert it to a new color space. Color space converter 404 may then send the pixel stream to display back end 430 or back onto system bus 420. In other embodiments, the pixel stream may be sent to other target destinations. For example, the pixel stream may be sent to a network interface for example. In some embodiments, a new color space may be chosen based on the mix of colors after blending and gamut corrections have been applied. In further embodiments, the color space may be changed based on the intended target display.

Display backend 430 may control the display to display the pixels generated by display pipeline 400. Display backend 430 may read pixels at a regular rate from an output FIFO (not shown) of display pipeline 400 according to a pixel clock. The rate may depend on the resolution of the display as well as the refresh rate of the display. For example, a display having a resolution of N×M and a refresh rate of R frames per second may have a pixel clock frequency based on N×M×R. On the other hand, the output FIFO may be written to as pixels are generated by display pipeline 400.

Display backend 430 may receive processed image data as each pixel is processed by display pipeline 400. Display backend 430 may provide final processing to the image data before each video frame is displayed. In some embodiments, display back end may include ambient-adaptive pixel (AAP) modification, dynamic backlight control (DPB), display panel gamma correction, and dithering specific to an electronic display coupled to display backend 430.

The parameters that display pipeline 400 may use to control how the various sub-blocks manipulate the video frame may be stored in control registers 405. These registers may include, but not limited to, setting input and output frame sizes, setting input and output pixel formats, location of the source frames, and destination of the output (display back end 430 or system bus 420). Control registers 405 may be loaded by parameter FIFO 406.

Parameter FIFO 406 may be loaded by a host processor, a direct memory access unit, a graphics processing unit, or any other suitable processor within the computing system. In other embodiments, parameter FIFO 406 may directly fetch values from a system memory, such as, for example, system memory 212 in FIG. 2. Parameter FIFO 406 may be configured to update control registers 405 of display processor 400 before each video frame is fetched. In some embodiments, parameter FIFO may update all control registers 405 for each frame. In other embodiments, parameter FIFO may be configured to update subsets of control registers 405 including all or none for each frame. A FIFO as used and described herein, may refer to a memory storage buffer in which data stored in the buffer is read in the same order it was written. A FIFO may be comprised of RAM or registers and may utilize pointers to the first and last entries in the FIFO.

In one embodiment, display pipeline 400 may utilize a separate requestor ID for each plane of the source pixel data. For example, a two-plane YUV source may be retrieved from memory and processed by two separate requestors, with a requestor for each plane. In one embodiment, display pipeline 400 may be processing two separate two-plane sources for a total of four requestor IDs.

It is noted that the display pipeline 400 illustrated in FIG. 4 is merely an example. In other embodiments, different functional blocks and different configurations of functional blocks may be possible depending on the specific application for which the display processor is intended. For example, more than two video/UI pipelines may be included within a display pipeline in other embodiments.

Figure 5:
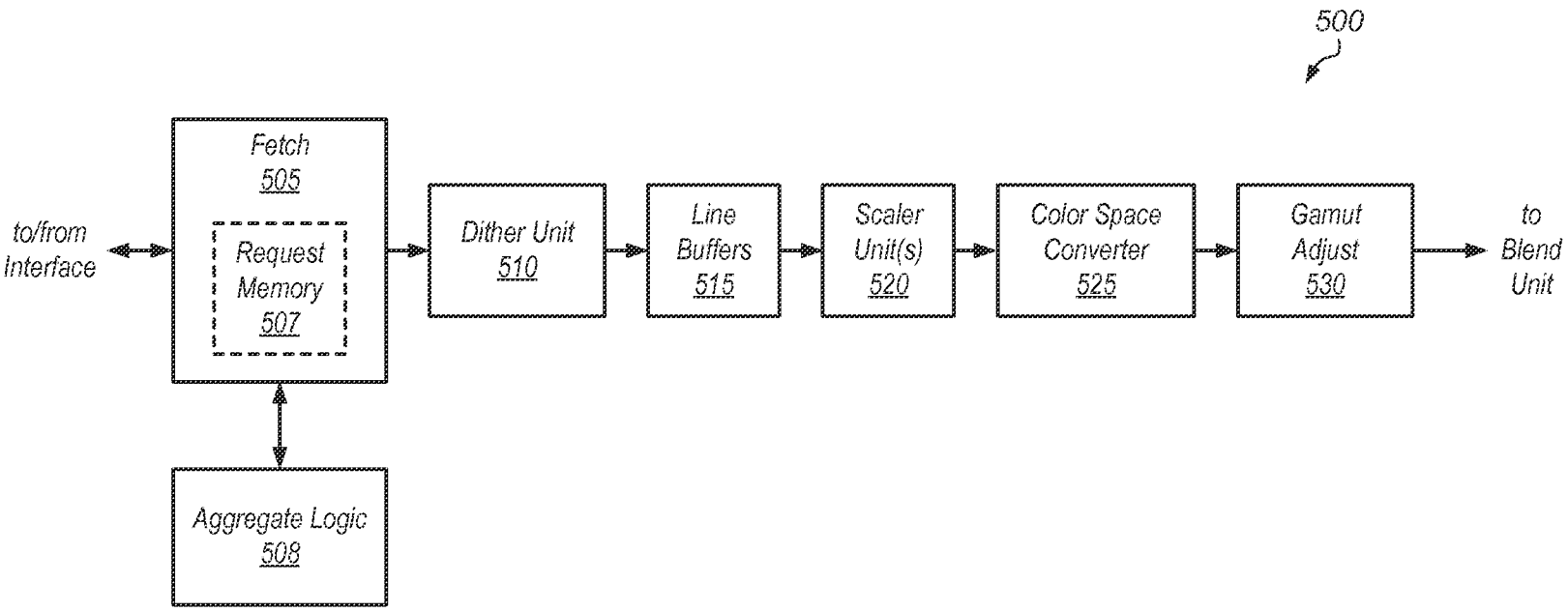
FIG. 5 is a block diagram illustrating one embodiment of a video/UI pipeline.

Referring to FIG. 5, a block diagram of one embodiment of a video/UI pipeline 500 is shown. Video/UI pipeline 500 may correspond to video/UI pipelines 401A and 401B of display pipeline 400 as illustrated in FIG. 4. In the illustrated embodiment, video/UI pipeline 500 includes fetch unit 505, aggregate logic 508, dither unit 510, line buffer 515, scaler unit(s) 520, color space converter 525, and gamut adjust unit 530. In general, video/UI pipeline 500 may be responsible for fetching pixel data for source frames stored in a memory, and then processing the fetched data before sending the processed data to a blend unit, such as, blend unit 402 of display pipeline 400 as illustrated in FIG. 2.

Fetch unit 505 may be configured to generate read requests for source pixel data needed by the requestor(s) of video/UI pipeline 500. The read requests may be generated and stored in a memory structure 507, such as a request queue(s). Alternatively, the request queue(s) 507 may be located in the interface or elsewhere in the host SoC (e.g., SoC 210 of FIG. 2). In one embodiment, there may be a request queue 507 for each requestor of video/UI pipeline 500. In another embodiment, multiple requestors may share a single request queue 507. In other embodiments, video/UI pipeline 500 may not use a request queue. Rather, in some embodiments a credit-based system may be utilized in which credits are allocated and used to issue requests in a large burst. In such a case, requests may be stored in any of a variety of memory structures other than queues per se. These and other embodiments are possible and are contemplated.

Response data corresponding to the read request may be stored in the line buffers 515. In one embodiment, a configuration register (not shown) may be located within the fetch unit 505. The configuration register may be programmable and store a threshold. The threshold may be a number of stored requests that is to be reached before a respective requestor becomes a candidate for request arbitration.

The aggregate logic 508 may monitor the number of stored requests and compare the number to the threshold. Alternatively, the aggregate logic 508 may monitor an amount of freed storage space, convert the amount of storage to a number of memory read requests, and compare the number to the threshold. In response to determining the number of memory read requests reaches the threshold and an aggregate condition is satisfied, such as a system idle state, then the aggregate logic 508 may submit to an arbiter the respective requestor as a candidate for submitting requests. Alternatively, the aggregate logic 508 may allow the fetch unit 505 to present memory read requests to the interface, which causes the corresponding requestor to become a candidate for arbitration. Until a given threshold is reached, the respective requestor may not send any requests to the memory controller or an indication as a candidate for arbitration to the arbitration logic. However, if a separate requestor has reaches their respective threshold, then the other requestors may be a candidate for arbitration even if they have yet to reach their corresponding thresholds. In one embodiment, the arbiter may be located within the communication fabric (e.g., communication fabric 227 of FIG. 2). In another embodiment, the arbiter may also be located outside of the pixel-processing pipelines but within the display pipeline.

When a given requestor is selected by arbitration logic for sending requests to a memory controller, the aggregate logic 508 may monitor when the associated number of stored requests is exhausted. In addition, if new requests are stored in the corresponding request queue 507 during this time, the aggregate logic 508 may allow those requests to be sent as well. The threshold for the number of stored requests may be a relatively large number. Therefore, a respective requestor may aggregate a relatively large number of memory access requests before becoming a candidate for arbitration. Accordingly, the shared memory may spend longer amounts of time in a low-power mode causing an overall reduction in power consumption.

Fetching the source lines from the source buffer is commonly referred to as a "pass" of the source buffer. An initial pass of the source buffer may, in various embodiments, include a fetch of multiple lines from the source buffer. In other embodiments, subsequent passes through of the source buffer may require fewer lines. During each pass of the source buffer, required portions or blocks of data may be fetched from top to bottom, then from left to right, where "top," "bottom," "left," and "right" are in reference to a display. In other embodiments, passes of the source buffer may proceed differently.

Each read request may include one or more addresses indicating where the portion of data is stored in memory. In some embodiments, address information included in the read requests may be directed towards a virtual (also referred to herein as "logical") address space, wherein addresses do not directly point to physical locations within a memory device. In such cases, the virtual addresses may be mapped to physical addresses before the read requests are sent to the source buffer. A memory management unit may, in some embodiments, be used to map the virtual addresses to physical addresses. In some embodiments, the memory management unit may be included within the display control unit, while in other embodiments, the memory management unit may be located elsewhere within a computing system.

Dither unit 510 may, in various embodiments, provide structured noise dithering on the Luma channel of YCbCr formatted data. Other channels, such as the chroma channels of YCbCr, and other formats, such as ARGB may not be dithered. In various embodiments, dither unit 510 may apply a two-dimensional array of Gaussian noise (i.e., statistical noise that is normally distributed) to blocks of the source frame data. A block of source frame data may, in some embodiments, include one or more source pixels. The noise may be applied to raw source data fetched from memory prior to scaling.

Line buffers 515 may be configured to store the incoming frame data corresponding to row lines of a respective display screen. The frame data may be indicative of luminance and chrominance of individual pixels included within the row lines. Line buffers 515 may be designed in accordance with one of various design styles. For example, line buffers 515 may be SRAM, DRAM, or any other suitable memory type. In some embodiments, line buffers 515 may include a single input/output port, while, in other embodiments, line buffers 515 may have multiple data input/output ports.

In some embodiments, scaling of source pixels may be performed in two steps. The first step may perform a vertical scaling, and the second step may perform a horizontal scaling. In the illustrated embodiment, scaler unit(s) 520 may perform the vertical and horizontal scaling. Scaler unit(s) 520 may be designed according to one of varying design styles. In some embodiments, the vertical scaler and horizontal scaler of scaler unit(s) 520 may be implemented as 9-tap 32-phase filters. These multi-phase filters may, in various embodiments, multiply each pixel retrieved by fetch unit 505 by a weighting factor. The resultant pixel values may then be added, and then rounded to form a scaled pixel. The selection of pixels to be used in the scaling process may be a function of a portion of a scale position value. In some embodiments, the weighting factors may be stored in a programmable table, and the selection of the weighting factors to use in the scaling may be a function of a different portion of the scale position value.

In some embodiments, the scale position value (also referred to herein as the "display position value"), may included multiple portions. For example, the scale position value may include an integer portion and a fractional portion. In some embodiments, the determination of which pixels to scale may depend on the integer portion of the scale position value, and the selecting of weighting factors may depend on the fractional portion of the scale position value. In some embodiments, a Digital Differential Analyzer (DDA) may be used to determine the scale position value.

Color management within video/UI pipeline 500 may be performed by color space converter 525 and gamut adjust unit 530. In some embodiments, color space converter 525 may be configured to convert YCbCr source data to the RGB format. Alternatively, color space converter may be configured to remove offsets from source data in the RGB format. Color space converter 525 may, in various embodiments, include a variety of functional blocks, such as an input offset unit, a matrix multiplier, and an output offset unit (all not shown). The use of such blocks may allow the conversion from YCbCr format to RGB format and vice-versa.

In various embodiments, gamut adjust unit 530 may be configured to convert pixels from a non-linear color space to a linear color space, and vice-versa. In some embodiments, gamut adjust unit 530 may include a Look Up Table (LUT) and an interpolation unit. The LUT may, in some embodiments, be programmable and be designed according to one of various design styles. For example, the LUT may include a SRAM or DRAM, or any other suitable memory circuit. In some embodiments, multiple LUTs may be employed. For example, separate LUTs may be used for Gamma and De-Gamma calculations.

It is note that the embodiment illustrated in FIG. 5 is merely an example. In other embodiments, different functional blocks and different configurations of functional blocks are possible and contemplated.

Figure 6:
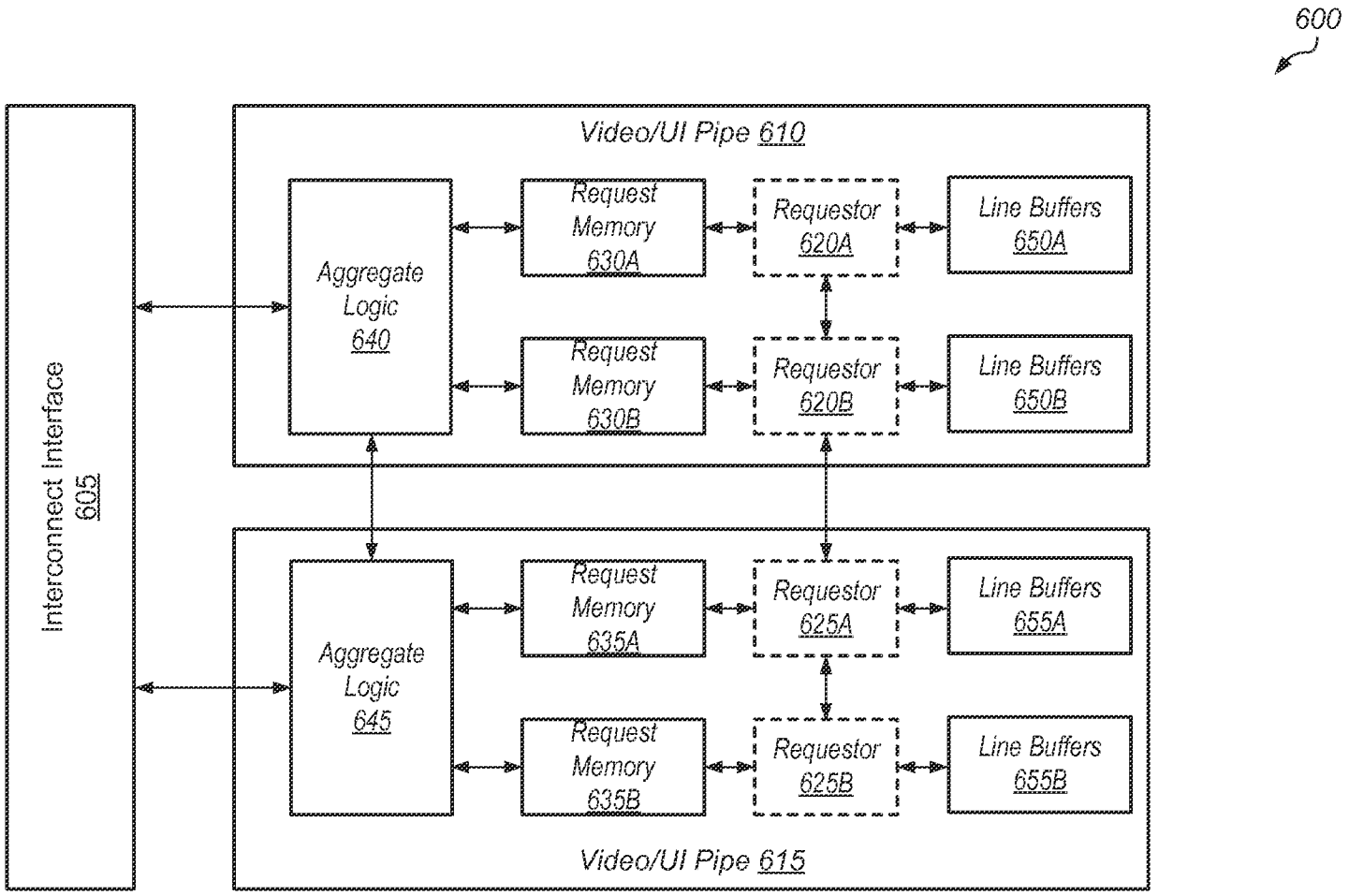
FIG. 6 is a block diagram illustrating one embodiment of a display pipeline.

Turning now to FIG. 6, one embodiment of a display pipeline 600 is shown. Display pipeline 600 includes video/UI pipes 610 and 615 which are representative of any number of video/UI, video, and/or UI pipes. Each video/UI pipe 610 and 615 may include any number of requestors, depending on the embodiment. As shown in FIG. 4, video/UI pipe 610 includes requestors 620A-B and video/UI pipe 615 includes requestors 625A-B.

In one embodiment, each requestor may correspond to a different layer of a user interface source frame or video source frame. Each requestor may generate read requests independently of the other requestors. In one embodiment, each of the plurality of requestors may utilize a separate, different identifier (ID) in their respective read requests.

In one embodiment, each requestor may operate in a burst mode to more efficiently utilize the memory subsystem which processes the requests to retrieve pixel data from shared memory. Each requestor may aggregate a programmable number of requests, and when a given requestor has accumulated the threshold number of requests, the requestor may be permitted to send requests to the interconnect interface 605. Accordingly, different requestors are often ready to transmit their aggregated requests at different times.

In one embodiment, each requestor may notify the other requestors when they are going to transmit requests. In another embodiment, requestors may monitor each other to detect requests being transmitted. When a first requestor reaches its aggregation limit and starts transmitting requests, the other requestors who have not yet reached their aggregation limits may also transmit their requests as rapidly as possible. In various embodiments, the first requestor may be configured to send a notification to one or more other requestors that it has reached its threshold. Alternatively, it may send a notification that it is transmitting requests (implicitly indicating it has reached its threshold). In some embodiments, other requestors may detect another requestor has reached its threshold or is transmitting requests by other means. For example, a status register or memory location could be maintained that indicates a status for each requestor. Numerous such embodiments are possible and are contemplated.

Each requestor may have a separate programmable aggregation threshold. In one embodiment, each requestor may wait to issue read requests until line buffer occupancy has dropped below a point corresponding to the threshold. In other words, when the corresponding line buffers have enough space for storing an amount of response data corresponding to a threshold number of read requests, then the requestor may commence issuing read requests. Accordingly, in this embodiment, requestors 620A-B may monitor the occupancy of line buffers 650A-B and requestors 625A-B may monitor the occupancy of line buffers 655A-B.

In another embodiment, each requestor may generate read requests and store the read requests in the corresponding request queue when space becomes available in the corresponding line buffers. Then, aggregation logic 640 and 645 may be configured to monitor the amount of requests in request queues 630A-B and request queues 635A-B, respectively, and issue requests to memory via interconnect interface 605 when the number of requests in a given request queue has reached the corresponding threshold for the given requestor. Also, when aggregation logic 640 or 645 has detected that a single requestor has reached its corresponding threshold number of requests, logic 640 or 645 may issue requests to memory for all of the requestors, even if the other requestors have yet to reach their corresponding thresholds. Sending requests from all requestors when only a single requestor has exceeded their threshold increases the bursty nature of request traffic and allows the memory subsystem to spend more time in a power savings mode.

It is noted that although request queues 630A-B and request queues 635A-B are shown in display pipeline 600, memory structures other than queues per se may be used. For example, in another embodiment, a credit-based scheme may be utilized. In such an embodiment, credits may be aggregated and then used to issue requests (e.g., in a large bursts) from a request memory. In this embodiment, aggregation logic 640 and 645 may be configured to monitor the number of aggregated credits for each of the requestors. Then, aggregation logic 640 and 645 may be configured to issue requests to memory from all requestors when the number of credits for a given requestor has reached its corresponding credit threshold.

It is further noted that each requestor 620A-B and 625A-B may have their own aggregation monitor, and each monitor may be configured to communicate with the other monitors. Each aggregation monitor may be configured to monitor the number of aggregated requests (or number of aggregated credits) for the corresponding requestor. When a given requestor has reached their threshold number of aggregated requests or credits, the aggregation monitor of the given requestor may be configured to notify the other aggregation monitors that they are now able to issue requests regardless of their current amount of aggregated requests or credits.

Additionally, in another embodiment, aggregate logic 640 and 645 (or other control logic) may monitor the processing of requests to determine when the end of the current frame is approaching. The condition when the end of the current frame is approaching may be detected when all remaining requests in a frame have been aggregated for all requestors. In response to detecting this condition (or receiving an indication that this condition has been detected), aggregate logic 640 and 645 may be configured to issue requests for all requestors once all remaining requests in a frame have been aggregated even if the aggregation threshold is not met.

Figure 7:
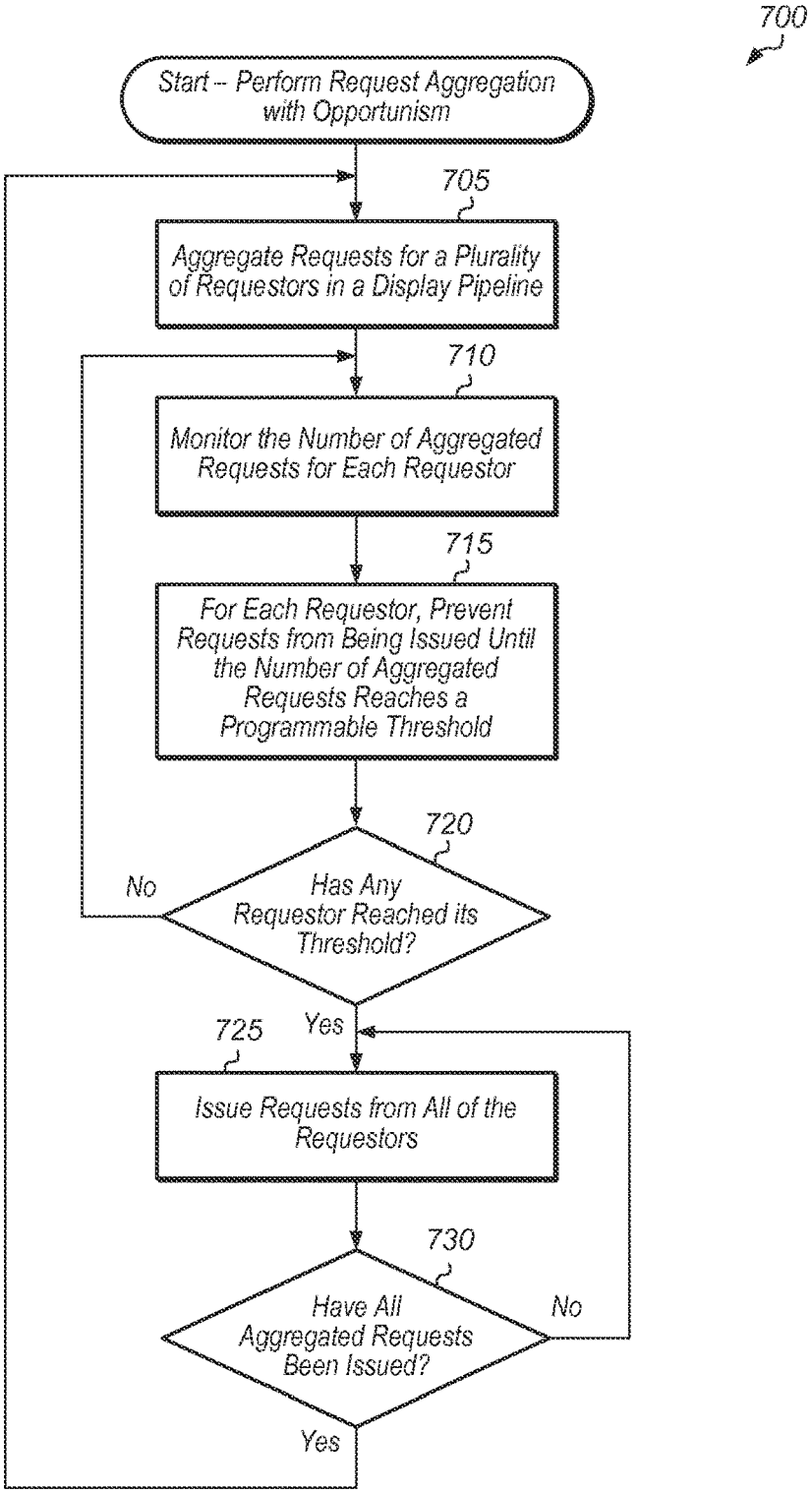
FIG. 7 is a generalized flow diagram illustrating one embodiment of a method for performing request aggregation with opportunism.

Referring now to FIG. 7, one embodiment of a method 700 for performing request aggregation with opportunism is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired.

Requests may be aggregated for each requestor of a plurality of requestors in a display pipeline (block 705). The number of aggregated requests may be monitored for each requestor (block 710). For each requestor, requests may be prevented from being issued until the number of aggregated requests reaches a programmable threshold corresponding to the given requestor (block 715). In one embodiment, each requestor may have a different programmable threshold, and the values of the programmable threshold may vary from requestor to requestor. In another embodiment, a single programmable threshold value may be utilized for all of the requestors.

The display pipe may determine if any of the requestors has a number of aggregated requests which is greater than the corresponding threshold (conditional block 720). If the number of aggregated requests for any requestor is greater than the corresponding threshold (conditional block 720, "yes" leg), then all requestors may opportunistically issue requests to memory even though only a single requestor has reached its corresponding threshold for aggregated requests (block 725). If the number of aggregated requests for any requestor is greater than the corresponding threshold (conditional block 720, "no" leg), then method 700 may return to block 710 and monitor the number of aggregated requests for each requestor.

After block 725, once all aggregated requests have been issued (conditional block 730, "yes" leg), then method 700 may return to block 705 and aggregate requests for each requestor of the plurality of requestors in the display control unit. New requests may continue to be generated while the existing requests are being issued to memory. In some embodiments, these requests may also be sent once all of the existing requests have been issued. If there are still pending requests that have not been issued (conditional block 730, "no" leg), then method 700 may return to block 725 and continue to issue requests from all of the requestors to the memory controller.

Figure 8:
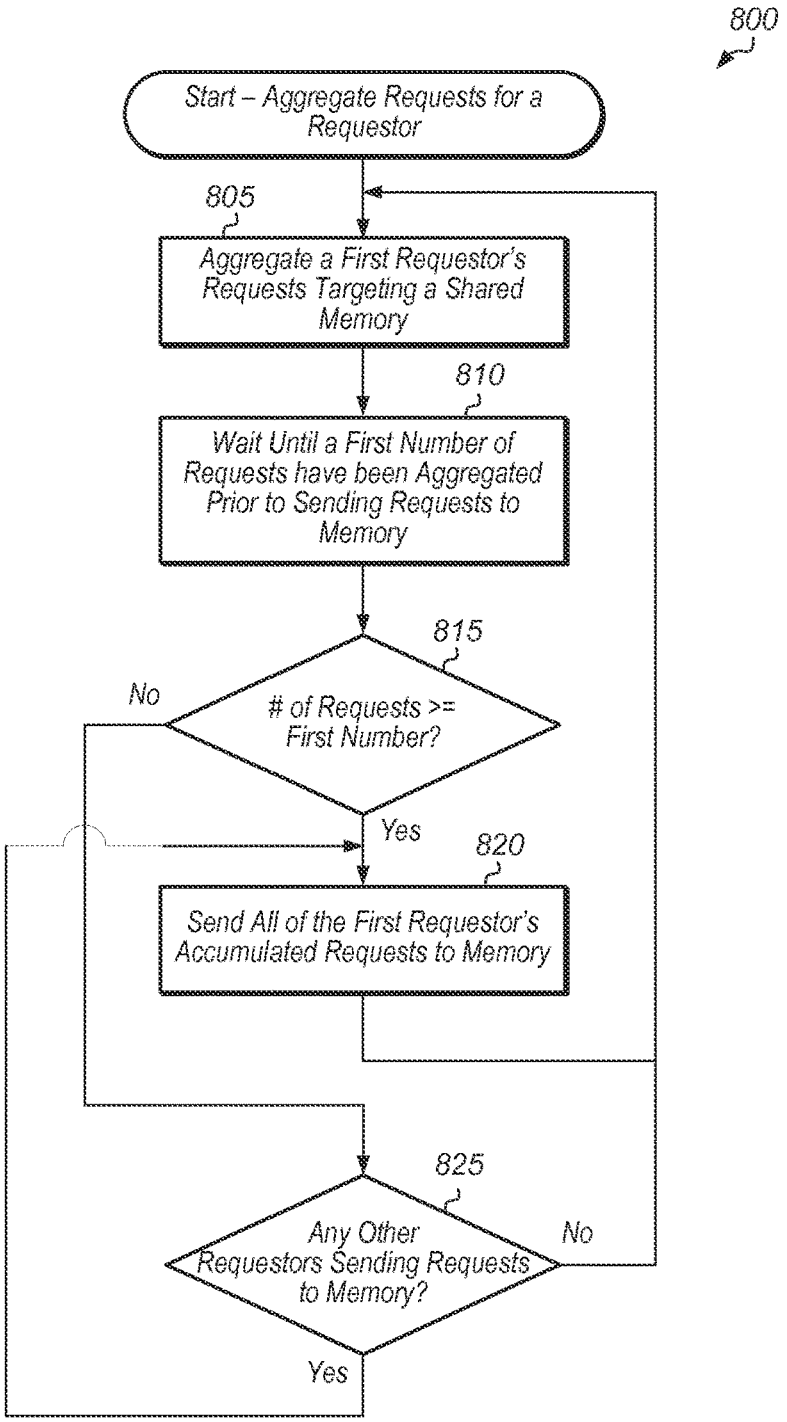
FIG. 8 is a generalized flow diagram illustrating one embodiment of a method for aggregating requests for a requestor.

Referring now to FIG. 8, one embodiment of a method 800 for aggregating requests for a requestor is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired.

A first requestor may aggregate requests targeting a shared memory (block 805). The first requestor may wait until a first number of requests have been aggregated prior to attempting to send requests from the first requestor to memory (block 810). If the number of requests is greater than or equal to the first number of requests (conditional block 815, "yes" leg), then the first requestor may send all of its accumulated requests to memory (block 820). After block 820, method 800 may return to block 805. If the number of requests is greater than or equal to the first number of requests (conditional block 815, "no" leg), then the first requestor may check to see if any other requestors are sending requests to memory (conditional block 825). In one embodiment, the first requestor may receive a notification from another requestor when the other requestor is sending requests to memory. In another embodiment, the first requestor may detect requests being sent from another requestor to memory.

If any other requestors are sending requests to memory (conditional block 825, "yes" leg), then the first requestor may send all of its accumulated requests to memory (block 820). It is noted that the number of accumulated requests being sent in this case may be less than the first number of requests. If no other requestors are sending requests to memory (conditional block 825, "no" leg), then method 800 may return to block 805 and the first requestor may continue aggregating requests targeting the shared memory.

Figure 9:
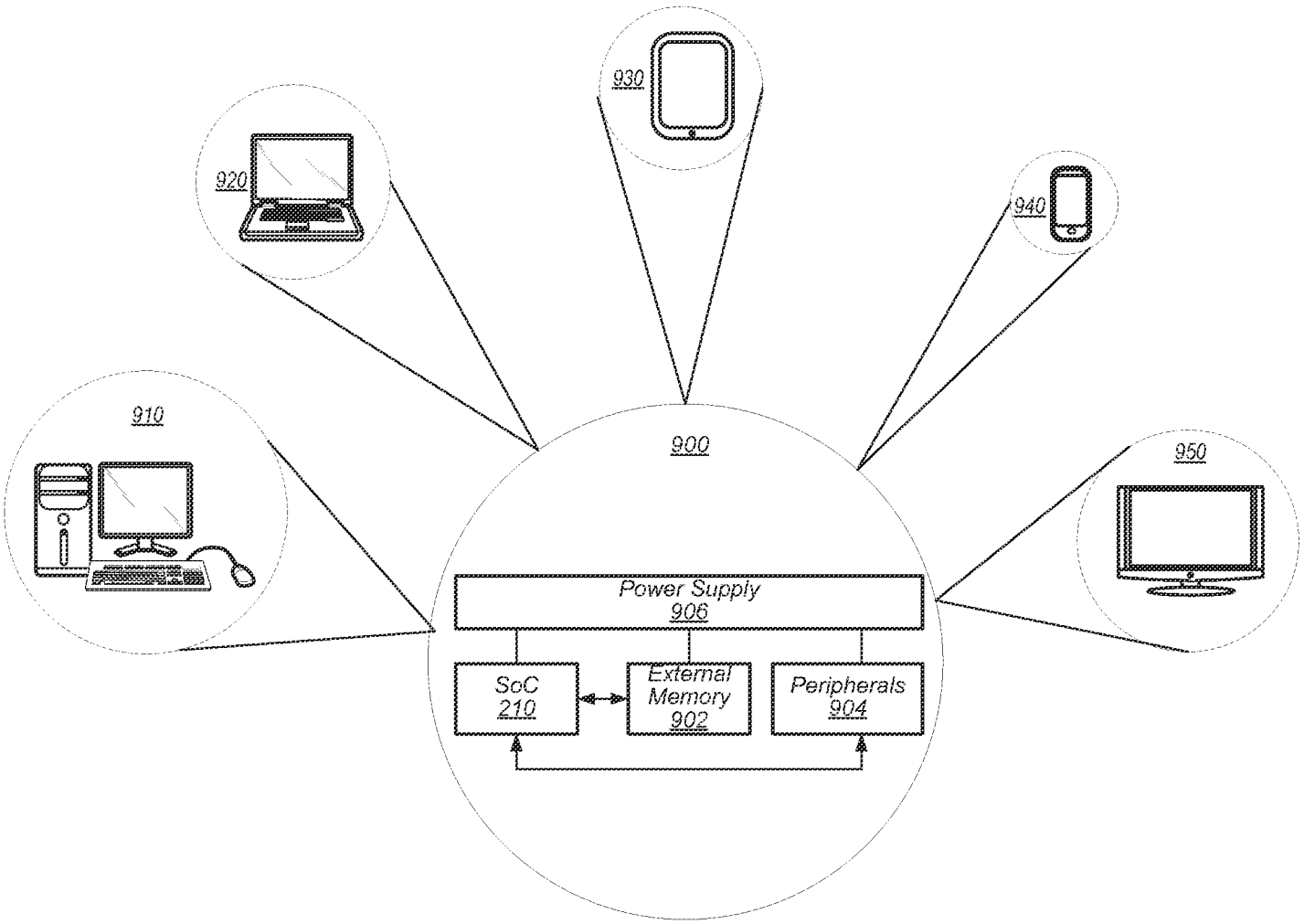
FIG. 9 is a block diagram of one embodiment of a system.

Referring next to FIG. 9, a block diagram of one embodiment of a system 900 is shown. As shown, system 900 may represent chip, circuitry, components, etc., of a desktop computer 910, laptop computer 920, tablet computer 930, cell phone 940, television 950 (or set top box configured to be coupled to a television), or otherwise. Other devices are possible and are contemplated. In the illustrated embodiment, the system 900 includes at least one instance of SoC 210 (of FIG. 2) coupled to an external memory 902.

SoC 210 is coupled to one or more peripherals 904 and the external memory 902. A power supply 906 is also provided which supplies the supply voltages to SoC 210 as well as one or more supply voltages to the memory 902 and/or the peripherals 904. In various embodiments, power supply 906 may represent a battery (e.g., a rechargeable battery in a smart phone, laptop or tablet computer). In some embodiments, more than one instance of SoC 210 may be included (and more than one external memory 902 may be included as well).

The memory 902 may be any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices may be coupled onto a circuit board to form memory modules such as single inline memory modules (SIMMs), dual inline memory modules (DIMMs), etc. Alternatively, the devices may be mounted with SoC 210 in a chip-on-chip configuration, a package-on-package configuration, or a multi-chip module configuration.

The peripherals 904 may include any desired circuitry, depending on the type of system 900. For example, in one embodiment, peripherals 904 may include devices for various types of wireless communication, such as wifi, Bluetooth, cellular, global positioning system, etc. The peripherals 904 may also include additional storage, including RAM storage, solid state storage, or disk storage. The peripherals 904 may include user interface devices such as a display screen, including touch display screens or multitouch display screens, keyboard or other input devices, microphones, speakers, etc.

In various embodiments, program instructions of a software application may be used to implement the methods and/or mechanisms previously described. The program instructions may describe the behavior of hardware in a high-level programming language, such as C. Alternatively, a hardware design language (HDL) may be used, such as Verilog. The program instructions may be stored on a non-transitory computer readable storage medium. Numerous types of storage media are available. The storage medium may be accessible by a computer during use to provide the program instructions and accompanying data to the computer for program execution. In some embodiments, a synthesis tool reads the program instructions in order to produce a netlist comprising a list of gates from a synthesis library.

It should be emphasized that the above-described embodiments are only non-limiting examples of implementations. Numerous variations and modifications will become apparent to those skilled in the art once the above disclosure is fully appreciated. It is intended that the following claims be interpreted to embrace all such variations and modifications.

What is claimed is:

1. A display pipeline comprising:

a plurality of requestors, wherein each requestor of the plurality of requestors has a corresponding threshold number of a plurality of requests to be aggregated before transmission of a request is permitted; and logic configured to monitor a number of pending requests that have been aggregated corresponding to each of the plurality of requestors;

wherein in response to determining a first requestor of the plurality of requestors has reached its corresponding threshold number of requests:

issue pending requests of the first requestor; and issue pending requests of one or more requestors of the plurality of requestors other than the first requestor, even though said one or more requestors have not aggregated their corresponding threshold number of requests.

2. The display pipeline as recited in claim 1, wherein each requestor of the plurality of requestors is configured to issue memory requests responsive to an indication that all remaining requests for a given frame have been aggregated.

3. The display pipeline as recited in claim 1, wherein the first requestor corresponds to a first plane of a source image, and wherein a second requestor of the plurality of requestors corresponds to a second plane of the source image.

4. The display pipeline as recited in claim 1, wherein the first requestor corresponds to a first plane of a first source image, and wherein a second requestor of the plurality of requestors corresponds to a first plane of a second source image.

5. The display pipeline as recited in claim 1, further comprising one or more programmable registers, each configured to store a value indicative of a threshold number for a requestor of the plurality of requestors.

6. The display pipeline as recited in claim 1, wherein in response to said determining, a notification that the first requestor has reached its threshold number of requests is conveyed to one or more of the other requestors.

7. The display pipeline as recited in claim 1, wherein one or more of the other requestors are configured to determine that the first requestor has reached its threshold number of requests via a status register.

8. An apparatus comprising:

a memory;

a display pipeline comprising a plurality of requestors, wherein each requestor of the plurality of requestors has a corresponding threshold number of a plurality of requests to be aggregated before transmission of a request is permitted; and an interface coupled between the display pipeline and the memory;

wherein the display pipeline is configured to:

monitor a number of pending requests that have been aggregated corresponding to each of the plurality of requestors; and in response to determining a first requestor of the plurality of requestors has reached its corresponding threshold number of requests:

issue pending requests of the first requestor; and issue pending requests of one or more requestors of the plurality of requestors other than the first requestor, even though said one or more requestors have not aggregated their corresponding threshold number of requests.

9. The apparatus as recited in claim 1, wherein each requestor of the plurality of requestors is configured to issue memory requests responsive to an indication that all remaining requests for a given frame have been aggregated.

10. The apparatus as recited in claim 1, wherein the first requestor corresponds to a first plane of a source image, and wherein a second requestor of the plurality of requestors corresponds to a second plane of the source image.

11. The apparatus as recited in claim 1, wherein the first requestor corresponds to a first plane of a first source image, and wherein a second requestor of the plurality of requestors corresponds to a first plane of a second source image.

12. The apparatus as recited in claim 1, further comprising a memory controller configured to control access to the memory.

13. The apparatus as recited in claim 1, wherein the display pipeline comprises a plurality of pixel processing pipelines, wherein the first requestor corresponds to a first pixel processing pipeline of the plurality of pixel processing pipelines, and wherein a second requestor of the plurality of requestors corresponds to a second pixel processing pipeline of the plurality of pixel processing pipelines.

14. The apparatus as recited in claim 1, wherein the display pipeline comprises a first pixel processing pipeline, wherein the first requestor corresponds to the first pixel processing pipeline, and wherein a second requestor of the plurality of requestors corresponds to the first pixel processing pipeline.

15. A method comprising:

monitoring a number of pending requests that have been aggregated corresponding to each of a plurality of requestors, wherein each requestor of the plurality of requestors has a corresponding threshold number of requests to be aggregated before transmission of a request is permitted; and in response to determining a first requestor of the plurality of requestors has reached its corresponding threshold number of requests:

issuing pending requests of the first requestor; and issuing pending requests of one or more requestors of the plurality of requestors other than the first requestor, even though said one or more requestors have not aggregated their corresponding threshold number of requests.

16. The method as recited in claim 15, wherein each requestor of the plurality of requestors is configured to issue memory requests responsive to an indication that all remaining requests for a given frame have been aggregated.

17. The method as recited in claim 15, wherein the first requestor corresponds to a first plane of a source image, and wherein a second requestor of the plurality of requestors corresponds to a second plane of the source image.

18. The method as recited in claim 15, wherein the first requestor corresponds to a first plane of a first source image, and wherein a second requestor of the plurality of requestors corresponds to a first plane of a second source image.

19. The method as recited in claim 15, wherein in response to said determining, the method comprises conveying a notification that the first requestor has reached its threshold number of requests to one or more of the other requestors.

20. The method as recited in claim 15, further comprising one or more of the other requestors determining that the first requestor has reached its threshold number of requests via a status register.

* * * * *